US005863239A

United States Patent [19]

Barton, II

[11] Patent Number: 5,863,239

[45] **Date of Patent: *Jan. 26, 1999**

[54] MICROFINISHING AND ROLLER BURNISHING MACHINE

[76] Inventor: Kenneth A. Barton, II, 1477 Haslett Rd., P.O. Box 609, Haslett, Mich. 48840

[ * ] Notice: The term of this patent shall not extend beyond the expiration date of Pat. No. 5,664,991.

[21] Appl. No.: 924,937

[22] Filed: Sep. 8, 1997

Related U.S. Application Data

[63] Continuation of Ser. No. 585,178, Jan. 11, 1996, Pat. No. 5,664,991.

[51] Int. Cl.[6] ..... B24B 7/00; B24B 9/00

[52] U.S. Cl. ..... 451/65; 451/242

[58] Field of Search ..... 451/65, 66, 11, 451/47, 249, 194, 209, 210, 246, 302, 307, 242, 54, 55

[56] References Cited

U.S. PATENT DOCUMENTS

| | | | |
|---|---|---|---|
| 705,593 | 7/1902 | Maldaner | 451/209 |
| 1,622,755 | 3/1927 | Asbridge | 451/209 |
| 3,710,514 | 1/1973 | Runge | 451/65 |
| 3,808,745 | 5/1974 | Belohoubek et al. | 451/56 |
| 4,144,676 | 3/1979 | Moll | 451/246 |
| 4,290,238 | 9/1981 | Judge, Jr. | 451/11 |
| 4,505,071 | 3/1985 | Schwar | 451/65 |
| 4,790,698 | 12/1988 | Heffron | 451/249 |
| 4,999,953 | 3/1991 | Kinugawa et al. . | |
| 5,095,727 | 3/1992 | Westerman et al. . | |
| 5,664,991 | 9/1997 | Bartoon, II | 451/65 |

*Primary Examiner*—Timothy V. Eley
*Assistant Examiner*—Derris H. Banks
*Attorney, Agent, or Firm*—Mick A. Nylander

[57] ABSTRACT

A surface finishing tool for use in combination with a power driver for rotating a workpiece about a central axis including a microfinishing assembly adapted to be positioned adjacent the workpiece and having at least one finishing means for surface finishing the workpiece, the finishing means lying in a plane generally perpendicular to the central axis of rotation of the workpiece and a burnishing assembly for applying a burnishing pressure to the workpiece, the burnishing assembly positioned adjacent the workpiece and spaced apart from the microfinishing assembly, the burnishing assembly having at least one burnishing roller lying in the plane generally perpendicular to the central axis of rotation of the workpiece wherein the microfinishing assembly and burnishing assembly are operable upon rotation of the workpiece to microfinish and burnish the workpiece respectively.

21 Claims, 2 Drawing Sheets

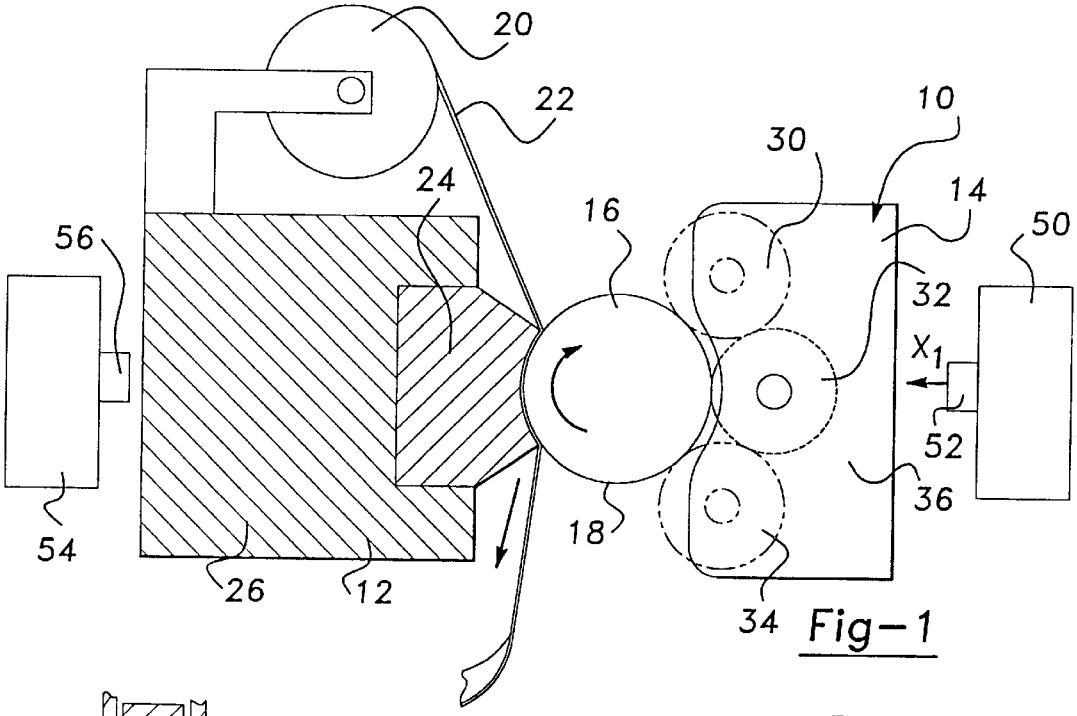
Fig-1
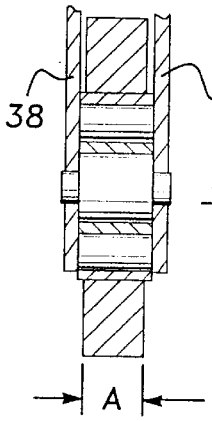
Fig-2
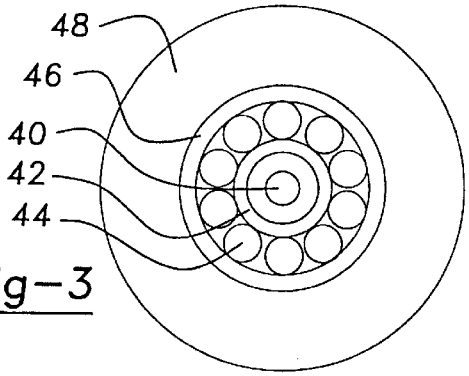
Fig-3
Fig-4
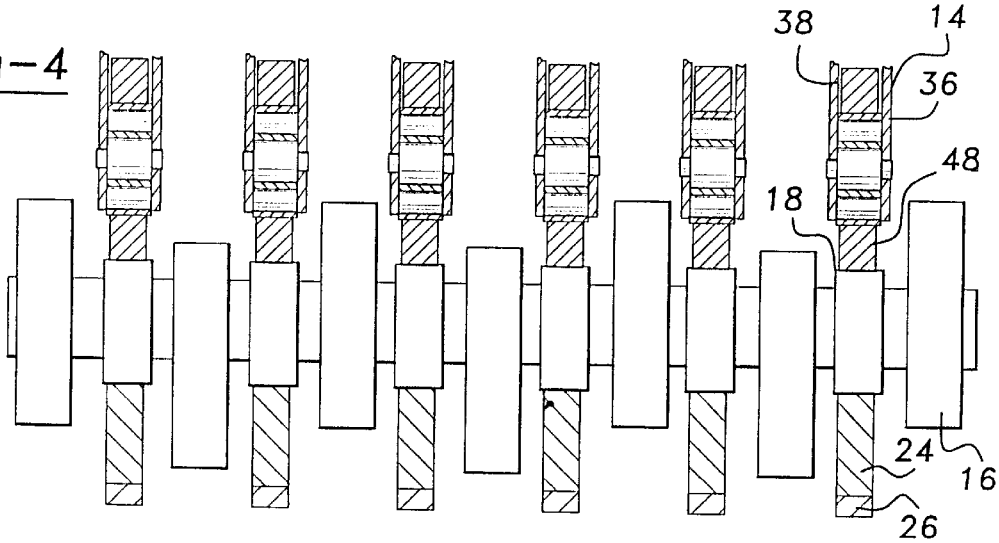

MICROFINISHING AND ROLLER BURNISHING MACHINE

This application is a continuation of application Ser. No. 08/585,178, filed Jan. 11, 1996, now U.S. Pat. No. 5,664, 991.

TECHNICAL FIELD

The present invention relates to microfinishing and burnishing metal working machines and techniques, and more particularly, to a combination machine that utilizes microfinishing and roller burnishing machine elements for use in providing a high quality surface finish to a load bearing surface.

BACKGROUND ART

Rapid changes in the precision requirements of various mechanical devices, machines and apparatus have brought to the forefront the need for better control of surface texture of manufactured parts. In combination, advancements in the metal working arts have made the production of higher quality surfaces a possibility and affordable to the metal parts manufacturer. Automotive products are currently designed to rigorous specifications that require proper quality control of critical load bearing surfaces for adequate operation and minimal maintenance.

Microfinishing or superfinishing, as it is known in the art, is a surface finishing process wherein a grinding means is brought to bear against a workpiece which has been previously rough ground. Microfinishing is a low velocity abrading process which generally follows rough grinding and finish grinding. Because microfinishing incorporates lower cutting speeds than grinding, heat and pressure variants may be minimized to provide improved size and geometry control. Those skilled in the art recognize that surface quality or roughness is measured in roughness average values ($R_a$) wherein $R_a$ is the arithmetical average deviation of minute surface irregularities from hypothetical perfect surfaces. Microfinishing can provide surface quality of approximately 0.025 to 0.25 $\mu$m. Load bearing surfaces of crankshafts, cam shafts, power transmission shafts in similar machine components that rotate on journal bearing surfaces generally require this surface finish for satisfactory operation.

Microfinishing may be accomplished using many different known forms or methods. Stone microfinishing uses a stationary honing stone which is brought against a desired bearing surface to be finished. Another method is described as conventional abrasive coated tape microfinishing. In this method a coated abrasive tape is brought into contact with a rotating bearing surface. As the part is rotated, the abrasive material reduces roughness of the surface. In the conventional process, the tape is brought into contact with the rotating surface by pressure exerted by compressible elastomeric inserts, typically made from urethane plastic materials. In yet a another method of microfinishing, a rigid insert is used to press abrasive coated tape or cloth material into contact with the rotating bearing surface.

Burnishing is the smoothing of the surface finish of workpieces by frictional, direct contact of a fixed or rotating tool under pressure. Burnishing is used as a finishing operation after a workpiece has been machined or ground to eliminate minute surface irregularities. Burnishing is to be distinguished from spinning operations wherein the tool is urged against a workpiece blank which is deformed into a desired shape usually in a series of passes with substantial deformation of material. A true roller burnishing operation is a cold working operation which does not remove material but compresses material. Roller burnishing compresses the microscopic peaks and valleys that are inherently left behind on the workpiece in metal turning operations.

Roller burnishing may provide surface quality of approximately 0.40 to 0.20 $\mu$m. Roller burnishing also increases surface hardness characteristics and improves overall surface geometry. Roller burnishing is capable of improving overall surface hardness by 10 to 30 percent over the initial hardness characteristics.

It is known that in the burnishing operation, microscopic peaks are broken off or deformed down into the adjacent microscopic valleys of the surface of the metal workpiece. It is also known that after repeated loads are placed on bearing surfaces, these previously burnished surfaces including the compacted or deformed microscopic peaks may fracture or become dislodged from the surface of the workpiece. These unattached microscopic contaminants are known to cause wear and breakdown of the bearing surface of the workpiece and mating parts over time.

It is also known that microfinishing, when applied properly and at the correct pressure and time variances, will remove the microscopic peaks from the surface to create the sought after microfinished surface. These peaks are then transported off the surface by the particular abrasive method used, such as the abrasive tape indexing method or changes to the honing stone materials or subsequent cleansing of the workpiece prior to installation.

The present invention solves the above noted problems and others in a manner not disclosed in the prior art.

SUMMARY OF THE INVENTION

A primary object of the present invention is to provide a combination microfinishing and burnishing tool capable of performing the operations of microfinishing and roller burnishing on a load bearing surface of a workpiece to provide a satisfactory surface finish, surface geometry, and surface hardness.

Yet, still another object of the present invention is to provide a microfinishing and burnishing tool capable of adequately performing the advantageous characteristics of microfinishing and burnishing metal working techniques in surface finish, surface geometry, and surface hardness simultaneously on a workpiece.

Still another object of the present invention is to provide a single surface finishing tool capable of microfinishing and burnishing a bearing surface of a workpiece in directly consecutive operations.

A further object of the present invention is to provide a single surface finishing tool capable of microfinishing and burnishing a bearing surface of a workpiece simultaneously.

Yet a further object of the present invention is to provide a surface finishing tool for use with a power driver for rotating a workpiece about a central axis comprising a microfinishing assembly adapted to be positioned adjacent to the workpiece and having at least one finishing means for surface finishing the workpiece, and at least one finishing means lying in a plane generally perpendicular to the central axis of rotation of the workpiece and a burnishing assembly for applying a burnishing pressure to the workpiece, the burnishing assembly positioned adjacent workpiece and spaced apart from the microfinishing assembly, the burnishing assembly having at least one burnishing roller lying in the plane generally perpendicular to the central axis of rotation of the workpiece wherein the microfinishing assembly and burnishing assembly are operable upon rotation of the workpiece to microfinish and burnish the workpiece respectively.

Yet still a further object of the present invention is a combination microfinishing and burnishing tool having at least one burnishing roller located directly opposite at least one finishing means.

Yet, still another object of the present invention is to provide a surface finishing machine including a power driver for rotating a workpiece about a central axis, a base for supporting the power driver, a microfinishing assembly adapted to be positioned adjacent to the workpiece and supported on the base, the microfinishing assembly having at least one finishing means for surface finishing the workpiece, the at least one finishing means lying in a plane generally perpendicular to the central axis of rotation of the workpiece and a burnishing assembly for applying a burnishing pressure to the workpiece, the burnishing assembly supported on the base and positioned adjacent workpiece and spaced apart from the microfinishing assembly, the burnishing assembly having at least one burnishing roller lying in the plane generally perpendicular to the central axis of rotation of the workpiece wherein the microfinishing assembly and burnishing assembly are operable upon rotation of the workpiece to microfinish and burnish workpiece respectively.

Yet, still another object of the present invention is the surface finish tool having a burnishing assembly for applying a burnishing pressure to the workpiece including a fixture body for rotatably supporting at least one burnishing and a biasing means for applying a force to the burnishing roller in a direction toward the central axis of rotation of the workpiece.

The above objects, features and advantages of the present invention, as well as others, are readily apparent from the foregoing detailed description of the invention in view of the drawings.

BRIEF DESCRIPTION OF THE DRAWINGS

FIG. 1 is a plan view of the surface finishing tool of the present invention, illustrating one embodiment of the microfinishing assembly and one embodiment of the burnishing assembly;

FIG. 2 is a side view of an alternative burnishing assembly of the present invention;

FIG. 3 is a side view of the burnishing roller of the present invention;

FIG. 4 is a partially cross sectioned view of the surface finishing tool of the present invention showing multiple finishing assemblies and burnishing assemblies.

BEST MODE FOR CARRYING OUT THE INVENTION

Figure 5:
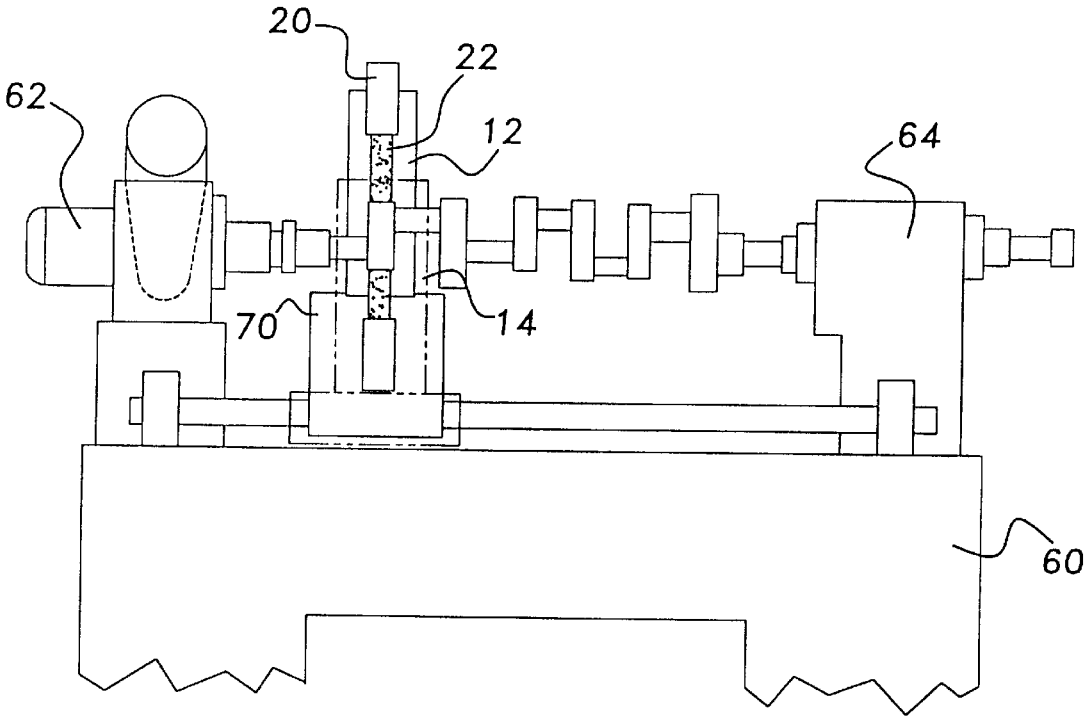
FIG. 5 is a side view of a finishing machine of the present invention.

Referring now to FIG. 1 there is shown generally, a surface finishing tool or assembly 10 of the present invention. Surface finishing assembly 10 includes a microfinishing assembly 12 and a burnishing assembly 14. A workpiece 16 having a bearing surface 18 is also shown disposed between the microfinishing assembly 12 and the burnishing assembly 14.

In one embodiment of the present invention, the microfinishing assembly 12 is comprised of an abrasive tape dispenser 20, abrasive tape 22, backup shoe 24 and shoe holder 26. In operation, the abrasive coated tape 22 is indexed, as known in the art, such that a new piece of abrasive tape 22 is provided adjacent the bearing surface 18 and the backup shoe 24. It is noted that microfinishing may utilize many different abrasive grinding materials instead of an abrasive coated tape. Other grinding materials include honing stones using diamond and carborundum, garnet, cubic boron nitride and other like substances. For more detail on microfinishing in general, applicant herein incorporates by reference, U.S. Pat. No. 5,437,125 entitled Surface Polishing Assembly, also owned by the applicant of the present invention.

Still referring to FIG. 1, there is shown one embodiment of the present invention having the burnishing assembly 14 comprised of a burnishing fixture body 28 which rotatably supports burnishing rollers 30, 32 and 34. Burnishing fixture body 28 includes a pair of side plates 36 and 38, as shown in FIG. 2.

FIGS. 2 and 3 illustrate the burnishing roller 32 of the present invention. Each burnishing roller 32 includes an axle 40, an inner race 42, a plurality of roller needle bearings 44, an outer race 46 and a burnishing contact roller 48. The burnishing contact roller is generally comprised of a hardened steel or like material having an equal or preferably greater hardness that the material which comprises the bearing surface to be processed. The burnishing contact roller shown is of a generally cylindrical shape which preferably has a width A, as shown in FIG. 2 which is equal or slightly greater than the width of the bearing surface to be processed.

Having described the structural characteristics of the present invention, attention is now turned to the advantageous operational characteristics derived therefrom. Referring now to FIG. 1, the general operation of the surface finishing tool of the present invention is described. There is shown workpiece 16, having bearing surface 18. For example purposes only, workpiece 16 is shown as a crankshaft and bearing surface 18 is the journal bearing surface which cooperates with the engine bearing journals and bearing caps not shown, to provide rotatable support for the crankshaft. This bearing surface 18 must be finished and hardened to such an extent to provide an adequate bearing contact surface for the crankshaft to operate. In the past, this surface may be microfinished at one machine after grinding to provide the adequate surface roughness characteristic of 12 Ra. The bearing surface 18 may also require a specific surface hardness that may only be achieved through burnishing. Both microfinishing and burnishing are processes that are used to reduce surface friction when the workpiece is rotated.

As discussed above, it is known that in the burnishing operation, microscopic peaks (not shown) are broken off or deformed down into the adjacent microscopic valleys of the surface of the metal workpiece or bearing surface. Repeated load on bearing surfaces such as bearing surface 18 may cause these previously burnished surfaces including the compacted or deformed microscopic peaks to fracture or become dislodged from the surface of the workpiece. These unattached microscopic contaminants are known to cause wear and breakdown of the bearing surface of the workpiece and mating part over time.

Microfinishing, when applied properly and at the correct pressure and time variances, will remove the microscopic peaks off from the surface 18 to create the appropriate surface roughness value sought after. The removed peaks are then transported off the surface by the particular abrasive method used, such as the abrasive tape 22 shown in FIG. 1.

Abrasive grit from the abrasive tape is washed away by the use of a stream of liquid, known as coolant in the industry. This coolant can be an oil, synthetic or water based.

The present invention provides for a microfinishing and burnishing operation to be carried out simultaneously on the same bearing surface 18. This affords the machinist the advantageous characteristics of microfinshing and burnishing. As shown in FIG. 1, the workpiece 16 is shown disposed between burnishing assembly 14 and microfinishing assembly 12. Workpiece 16 is rotated by any known means to approximately 60 to 200 revolutions per minute (rpm) to provide an adequate speed for both the microfinishing and burnishing operations.

In one embodiment of the present invention, as shown in FIG. 1, a lateral pressure or force of X1 of approximately 100–1000 ft-lbs if applied to the burnishing assembly 14. This pressure is based on the workpiece bearing surface diameter, width, material hardness and the desired surface characteristics. A pressure in a range from 20 to 100 ft-lbs is capable of providing adequate force to operate both a microfinishing operation. As shown, a pressure X1 is applied to fixture body 28 toward the central axis of rotation of workpiece 16 by a biasing fixture 50. Biasing fixture 50 includes a pneumatic biasing cylinder 52 for applying the appropriate force to the fixture body 14. This force is subsequently translated to the burnishing roller 48 shown in FIG. 3. It is contemplated that any means for applying a force to the fixture body will suffice to operate the present invention, as long as the force is in a controllable known manner. For example, a hydraulic biasing cylinder, solenoid, or any mechanical means for applying the requisite force may be sufficient if capable of providing the controlled force in the appropriate direction described above.

In the above described embodiment, the microfinishing assembly is configured to either be completely stationary or capable of movement in the lateral direction to position the workpiece 16. The microfinishing operating pressure, X2, described below, is independently controlled from the burnishing pressure X1. In this manner the applied pressure X1 does not affect the microfinishing pressure. It is contemplated that with a higher burnishing pressure X1, a roller type back up unit, not shown, may be required to offset the higher burnishing pressure. This roller type back up unit, known in the art, prevents the workpiece from bending or deforming during the burnishing operation.

In another embodiment shown in phantom in FIG. 1, additional burnishing rollers 30 and 34 are affixed to fixture body 28 to provide a different burnishing contact configuration. This configuration has the advantage of improving workpiece roundness, supplying a spaning type force for application where the rollers travel over an open area such as an oil hole. In the multiple roller arrangement, the total force applied to the surface is the same as a single roller, but the force is divided equally among the rollers. The multiple rollers thus allow a variance in burnish pressure per roller. The present invention contemplates any configuration of the three burnishing rollers 30, 32 and 34 depending upon the particular operation and bearing surface finish desired. It is also contemplated that more than three burnishing rollers may be used by downsizing the burnishing rollers themselves, again depending upon the particular operation and bearing surface finish desired.

In another embodiment of the present invention, the microfinishing assembly of the present invention is affixable to a means for providing a lateral pressure or force X2 of approximately 20–100 ft-lbs to the microfinishing assembly 12. As shown, a pressure X2 is applied to shoe holder 26 toward the central axis of rotation of workpiece 16. This pressure X2 is applied by a microfinishing biasing fixture 54. Biasing fixture 54 includes a pneumatic biasing cylinder 56 for applying the appropriate force to the microfinishing fixture body 54. This force is subsequently translated to the backup shoe 24 and abrasive tape 22. It is contemplated that any means for applying a force to the microfinishing fixture body 54 will suffice to operate the present invention, as long as the force is in a controllable in a known manner. For example, a hydraulic biasing cylinder, solenoid, or any mechanical means for applying the requisite force may be sufficient if capable of providing the controlled force in the appropriate direction described above.

In still a different embodiment of the present invention, lateral forces X1 and X2 may be applied simultaneously. The alternative embodiment of the present invention provides a machine including means for applying the pressures X1 and X2, as described independently above, at the same time. In this embodiment, a different set or process requirements may be achieved by altering the X1 and X2 pressures. It is contemplated that in this embodiment, pressures for X1 may range from 60 to 1000 ft-lbs and pressures for X2 may range from 20 to 100 ft-lbs.

Referring now to FIG. 4, there is shown a further embodiment of the present invention. In FIG. 4, there is shown a plurality of combination microfinishing assemblies 12 and burnishing assemblies 14. Workpiece 16 is illustrated operatively disposed between the opposing microfinishing assemblies 12 and burnishing assemblies 14 such that the appropriate, respective bearing surface 18 may be worked on.

FIG. 5 illustrates an example of a compact machine of the present invention. There is shown a base 60, with a headstock 62 for providing driver means for rotating workpiece 16. A tailstock 64 is shown at the opposing end of workpiece 16 for operatively rotatably supporting the workpiece 16. There is also shown one microfinishing assembly 12 and burnishing assembly 14 (in phantom). Further FIG. 5 shows an oscillating unit 70, connected to the microfinishing assembly 12 for inducing an oscillating motion in said micro-finishing assembly 12 during the microfinishing operation. This oscillation improves the overall surface finish characteristics of the part and may be desired in some applications. It is contemplated by the present invention that the workpiece may also be oscillated to provide the appropriate oscillating motion for surface finish of the part.

The best mode for carrying out the invention has been described in detail, those familiar with the art to which this invention relates will recognize various alternative designs and embodiments for practicing the invention as defined by the following claims.

What is claimed is:

1. A surface finishing tool for use with a power means for rotating a workpiece about a central axis comprising:

a microfinishing assembly adapted to be positioned adjacent said workpiece and having at least one finishing means for surface finishing said workpiece, said at least one finishing means lying in a plane generally perpendicular to said central axis of rotation of said workpiece; and a burnishing assembly for applying a burnishing pressure to said workpiece, said burnishing assembly positioned adjacent said workpiece and spaced apart from said microfinishing assembly, said burnishing assembly having a pair of burnishing rollers lying in said plane generally perpendicular to said central axis of rotation of said workpiece and wherein said microfinishing assembly and burnishing assembly are operable upon rotation of said workpiece to microfinish and burnish said workpiece respectively such that when said burnishing assembly is applying pressure to said workpiece, a total force applied to the workpiece from said burnishing assembly is divided equally between said pair of burnishing rollers.

2. The surface finishing tool of claim 1 wherein said burnishing assembly and microfinishing assembly are operable simultaneously to microfinish and burnish said workpiece simultaneously.

3. The surface finishing tool of claim 1 wherein said burnishing assembly is located directly opposite said at least one finishing means.

4. The surface finishing tool of claim 1 wherein said burnishing assembly further comprises:

a fixture body for rotatably supporting said at least one burnishing roller; and a means for applying a force to said burnishing assembly in a direction toward said central axis of rotation of said workpiece.

5. The surface finishing tool of claim 4 wherein said means for applying a force is a liquid biasing cylinder affixed to said fixture body.

6. The surface finishing tool of claim 1 wherein said at least one finishing means is a backup shoe, a shoe holder and an abrasive coated tape.

7. The surface finishing tool of claim 1 wherein said at least one finishing means is honing stone.

8. A combination surface finishing machine for microfinishing and burnishing a workpiece comprising:

a base;

a driver means for rotating said workpiece about a central axis, said driver means supported on said base;

at least one microfinishing assembly affixed to said base, said microfinishing assembly adapted to be positioned adjacent said workpiece and having at least one finishing means for surface finishing said workpiece, said at least one finishing means lying in a plane generally perpendicular to said central axis of rotation of said workpiece; and at least one burnishing assembly affixed to said base, said burnishing assembly for applying a burnishing pressure to said workpiece, said burnishing assembly positioned adjacent said workpiece and spaced apart from said microfinishing assembly, said burnishing assembly having a pair of burnishing rollers lying in said plane generally perpendicular to said central axis of rotation of said workpiece wherein said microfinishing assembly and burnishing assembly are operable upon rotation of said workpiece to microfinish and burnish said workpiece respectively such that when said burnishing assembly is applying pressure to said workpiece, a total force applied to the workpiece from said burnishing assembly is divided equally between said pair of burnishing rollers.

9. The surface finishing machine of claim 8 wherein said burnishing assembly and microfinishing assembly are operable simultaneously to microfinish and burnish said workpiece simultaneously.

10. The surface finishing machine of claim 8 wherein said burnishing assembly is located directly opposite said at least one finishing means.

11. The surface finishing machine of claim 8 wherein said burnishing assembly further comprises:

a fixture body for rotatably supporting said at least one burnishing roller; and a means for applying a force to said burnishing assembly in a direction toward said central axis of rotation of said workpiece.

12. The surface finishing machine of claim 11 wherein said means for applying a force is a liquid biasing cylinder affixed to said fixture body.

13. The surface finishing machine of claim 8 wherein said at least one finishing means is a backup shoe, a shoe holder and an abrasive coated tape.

14. The surface finishing machine of claim 8 wherein said finishing means is honing stone.

15. A combination surface finishing machine for microfinishing and burnishing a workpiece comprising:

a base;

a driver means for rotating said workpiece about a central axis, said driver means supported on said base;

a oscillating means for inducing an oscillating motion in said workpiece while said workpiece is rotating;

at least one microfinishing assembly affixed to said base, said microfinishing assembly adapted to be positioned adjacent said workpiece and having at least one finishing means for surface finishing said workpiece, said at least one finishing means lying in a plane generally perpendicular to said central axis of rotation of said workpiece; and at least one burnishing assembly affixed to said base, said burnishing assembly for applying a burnishing pressure to said workpiece, said burnishing assembly positioned adjacent said workpiece and spaced apart from said microfinishing assembly, said burnishing assembly having a pair of burnishing rollers lying in said plane generally perpendicular to said central axis of rotation of said workpiece wherein said microfinishing assembly and burnishing assembly are operable upon rotation of said workpiece to microfinish and burnish said workpiece respectively such that when said burnishing assembly is applying pressure to said workpiece, a total force applied to the workpiece from said burnishing assembly is divided equally between said pair of burnishing rollers.

16. The combination surface finishing machine of claim 15 wherein said burnishing assembly and microfinishing assembly are operable simultaneously to microfinish and burnish said workpiece simultaneously.

17. The combination surface finishing machine of claim 15 wherein said burnishing assembly is located directly opposite said at least one finishing means.

18. The combination surface finishing machine of claim 15 wherein said burnishing assembly further comprises:

a fixture body for rotatably supporting said at least one burnishing roller; and a means for applying a force to said burnishing assembly in a direction toward said central axis of rotation of said workpiece.

19. The combination surface finishing machine of claim 18 wherein said means for applying a force is a liquid biasing cylinder affixed to said fixture body.

20. The combination surface finishing machine of claim 15 wherein said finishing means is a backup shoe, a shoe holder and an an abrasive coated tape.

21. The combination surface finishing machine of claim 15 wherein said finishing means is honing stone.

* * * * *